United States Patent [19]

Crain, Jr.

[11] 4,230,302

[45] Oct. 28, 1980

[54] CARPET STRETCHER

[75] Inventor: Millard Crain, Jr., Pleasanton, Calif.

[73] Assignee: Crain Cutter Co., Inc., Santa Clara, Calif.

[21] Appl. No.: 58,959

[22] Filed: Jul. 19, 1979

[51] Int. Cl.[3] ..... A47G 27/04

[52] U.S. Cl. ..... 254/212

[58] Field of Search ..... 254/57-63; 269/167

[56] References Cited

U.S. PATENT DOCUMENTS

| | | | |
|---|---|---|---|
| 1,579,002 | 3/1926 | Koch | 269/167 |
| 2,221,325 | 11/1940 | Holman | 269/167 |
| 2,415,303 | 2/1947 | Moore | 269/167 |
| 3,693,936 | 9/1972 | Payson | 254/62 |

FOREIGN PATENT DOCUMENTS

| | | | |
|---|---|---|---|
| 450351 | 8/1948 | Canada | 269/167 |

*Primary Examiner*—Robert C. Watson
*Attorney, Agent, or Firm*—Jack M. Wiseman

[57] ABSTRACT

A carpet stretcher comprising a pin head. Extending from the pin head in a rearward direction is a sliding bar having a square cross-sectional area. Tubular telescoping extension members freely receive the sliding bar which extends in the axial direction thereof. At the free end of the tubular members is pivotally mounted a wall engaging member. At the opposite end of the tubular members is pivotally mounted a locking lever. A handle is pivotally mounted on the pin head and extends toward the tubular members. Intermediate the ends of the handle is linkage that pivotally connects the handle to the tubular members. Initially, the handle is depressed to apply an axial stretching force to a portion of a carpet. Stretched carpeting produces an axial reactive force within the carpet stretcher. After the portion of the carpet is stretched to the desired extent, the operator actuates the locking lever, which engages the sliding bar through a pivotal movement to retain the sliding bar in the extended position relative to the tubular members against the axial reactive force resulting from the stretched portion of the carpet. Subsequently, the operator again depresses the handle to release the axial reactive force and to enable the locking lever to assume a position for the sliding bar to move freely relative thereto.

11 Claims, 4 Drawing Figures

Fig-3
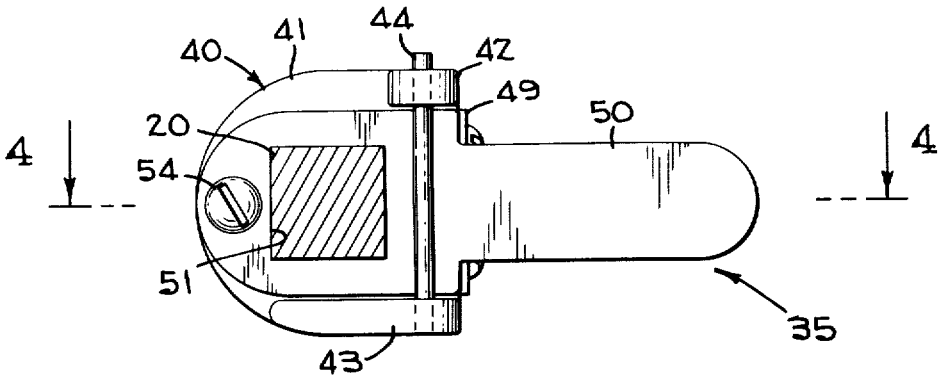
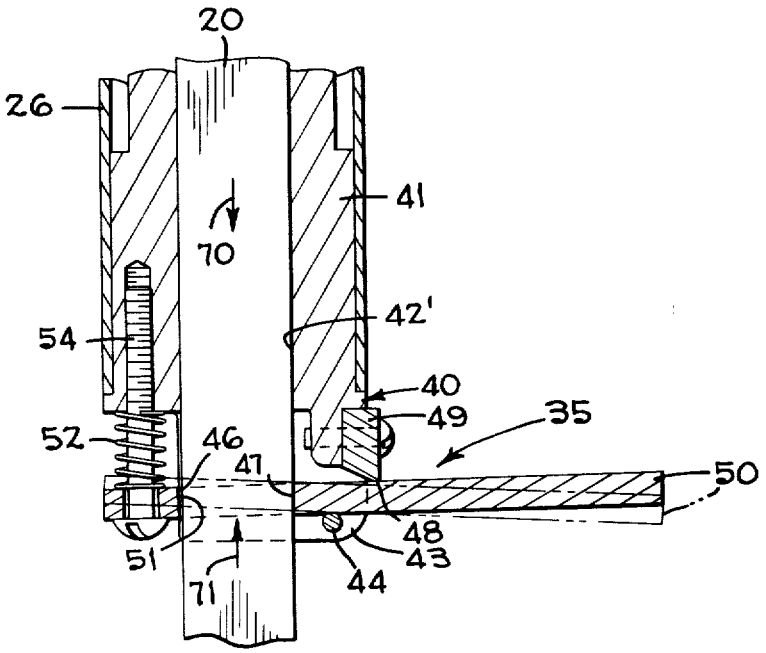
Fig-4

CARPET STRETCHER

BACKGROUND OF THE INVENTION

The present invention relates in general to carpet stretchers, and more particularly to a manually powered carpet stretcher with a locking mechanism.

In the patent to Payson, U.S. Pat. No. 3,692,278, issued on Sept. 19, 1972, for Carpet Stretcher With Ratchet Handle, there is disclosed a hand powered carpet stretcher with telescopic tubular members. A pivotal handle extends from a pin head. A link interconnects the handle and a tubular member. A ratchet interconnects the handle and the link. A pawl is mounted on the handle to engage the link to lock the pin head at a selected position. A rod or the handle is actuated to release the pawl from the ratchet.

The patent to Payson, U.S. Pat. No. 3,693,936, issued on Sept. 26, 1972, for Carpet Stretcher Improvements, discloses a sliding tube extending rearwardly from a pin head into a tubular extension member. A handle is pivotally attached to the rear of the pin head. A link interconnects the handle and the tubular extension member. A rack is formed on the sliding tube and a pawl is mounted on the tubular extension member. The pawl engages the rack to retain the sliding tube in an adjusted position relative to the tubular extension member. A rod retracts the pawl from the rack to release the sliding tube. In another version of the carpet stretcher, a ratchet is on the link and the pawl is mounted on the handle. A lever on the handle retracts the pawl from the ratchet to release the pawl from locking engagement with the rack. In still another version of the carpet stretcher, the locking tube is formed with a rack. The pawl is mounted in a pawl housing, which is mounted on the tubular extension member. The link is also secured to the pawl housing. A second link extends from the first-mentioned link to a lever for the pawl. When the handle is moved downwardly to stretch the carpet, the lever releases the pawl to enable a spring to urge the pawl in engagement with the ratchet. When the handle is raised, tension on the carpet is relaxed and the lever retracts the pawl from engagement with the rack.

In the patent to Payson, U.S. Pat. No. 3,791,624, issued on Feb. 12, 1974, for Extendible Tube Assembly, there is disclosed a carpet stretcher in which tubular members are disposed in a telescopic arrangement. A lock tube is fixed in one tubular member and extends into another tubular member. A lock collar that may be spring loaded or may be tiltable through engaging and non-engaging angles engages the lock tube to retain the tubular members in an adjusted fixed position relative to one another. The lock collar is released by the actuation of a longitudinally extending rod within a tubular member or a concentric tube disposed within a tubular member. This patent also discloses a pin head from which extends a locking shaft that slides into a tubular member. A link interconnects a handle and the tubular member. A rack and pawl arrangement between the tubular member and the lock shaft holds the lock shaft in a selected position relative to the tubular member. A cable and lever or a push rod on the handle retracts the pawl from the rack to release the lock shaft.

The patent to Payson, U.S. Pat. No. 3,917,225, issued on Nov. 4, 1975, for Carpet Stretcher Improvements discloses a handle pivotally attached to the pin head. Extending from the pin head is a sliding rod that is received by a tubular member. A link interconnects the handle with the tubular member. A spring loaded lock collar on the tubular member has an aperture to receive the sliding rod and is movable between a locking position and release position for locking engagement and disengagement with the sliding rod. A spring urges the lock collar into lock engagement with the sliding rod and a lever and cable arrangement extending from the handle releases the lock collar from locking engagement with the sliding rod. In a modified carpet stretcher, there are two lock collars to perform a stepping action. The rear collar is movable forwardly of the locking rod, while the forward collar locks the locking rod against movement as the handle is raised and is locked in position as the handle is lowered. The coupling assembly can be pumped rearwardly by the handle. Lifting of the handle disengages the locking action of the rear collar and releases the applied tension to the carpet. Full release is attained by disengaging both collars to free the sliding rod within the tubular member.

In the patent to Payson, U.S. Pat. No. 4,076,213, issued on Feb. 28, 1978, for Locking Tube Assembly, there is disclosed extensible, telescoping tubular members. One member includes a spring loaded, pivotal lock collar that is apertured to receive a sliding rod. The sliding rod is attached to the other tubular member. A lever is attached to the collar and extends radially outward from the one tubular member. The lever is actuated to release the lock collar from locking engagement with the slding rod.

Roberts Consolidated Industries, City of Industry, California, has manufactured and sold power stretchers. In one model, a switch on the handle is employed to lock a stretch in any position.

SUMMARY OF THE INVENTION

A carpet stretcher comprising a pin head from which extends a sliding bar. A tubular assembly freely receives the sliding bar for movement in the axial direction thereof. At the free end of the tubular assembly is a wall engaging member. At the other end of the tubular assembly is a pivotally mounted locking lever that is apertured in the transverse direction to receive the sliding bar. The locking lever is movable to a bar engaging position to retain the pin head at a selected distance from the wall engaging member and a release position in which the locking lever releases the bar from engagement therewith. A handle is pivotally mounted to the pin head and a link interconnects the handle with the tubular assembly. After the handle is lowered to stretch the carpet to a desired extent through an axial force produced through the carpet stretcher, the locking lever is actuated to engage the sliding bar for retaining the sliding bar in the carpet stretching position against an axial reactive force resulting from a stretched carpet. Subsequently, the handle is depressed for releasing the axial reactive force and for enabling the locking lever to be released from locking engagement with the sliding bar.

By virtue of the present invention, there is a direct and positive arrangement for retaining a sliding bar, which is fixed to the pin head, in the carpet stretching position against an axial reactive force resulting from the stretched carpet.

A feature of the present invention is the provision of a lighter carpet stretcher that is less fatiguing to the operator.

The present invention enables an operator during seaming to align patterns of juxtaposed carpet sections with greater facility by providing improved control over the axial reactive force resulting from stretched carpet sections.

In certain carpet stretchers, the locking of the pin head against the reactive forces of a stretched carpet occurred only when the handle was fully depressed. Therefore, the operator required special skills to be certain that the correct stretching extent of the carpet occurred only when the handle was fully depressed. Through the present invention, the correct stretching extent can take place at any position of the handle along the arc of travel of the handle and need not occur only when the handle is fully depressed. In the carpet stretcher of the present invention, the pin head can be retained in the desired extended position at any arc position of the handle and is released from the desired extended position by the further depressing of the handle.

DESCRIPTION OF THE DRAWINGS

FIG. 3 is a fragmentary vertical sectional view of the carpet stretcher shown in FIG. 1 taken along line 3—3 of FIG. 1.

FIG. 4 is a fragmentary horizontal sectional view of the carpet stretcher shown in FIG. 1 taken along line 4—4 of FIG. 3.

DESCRIPTION OF THE PREFERRED EMBODIMENT

Figure 1:
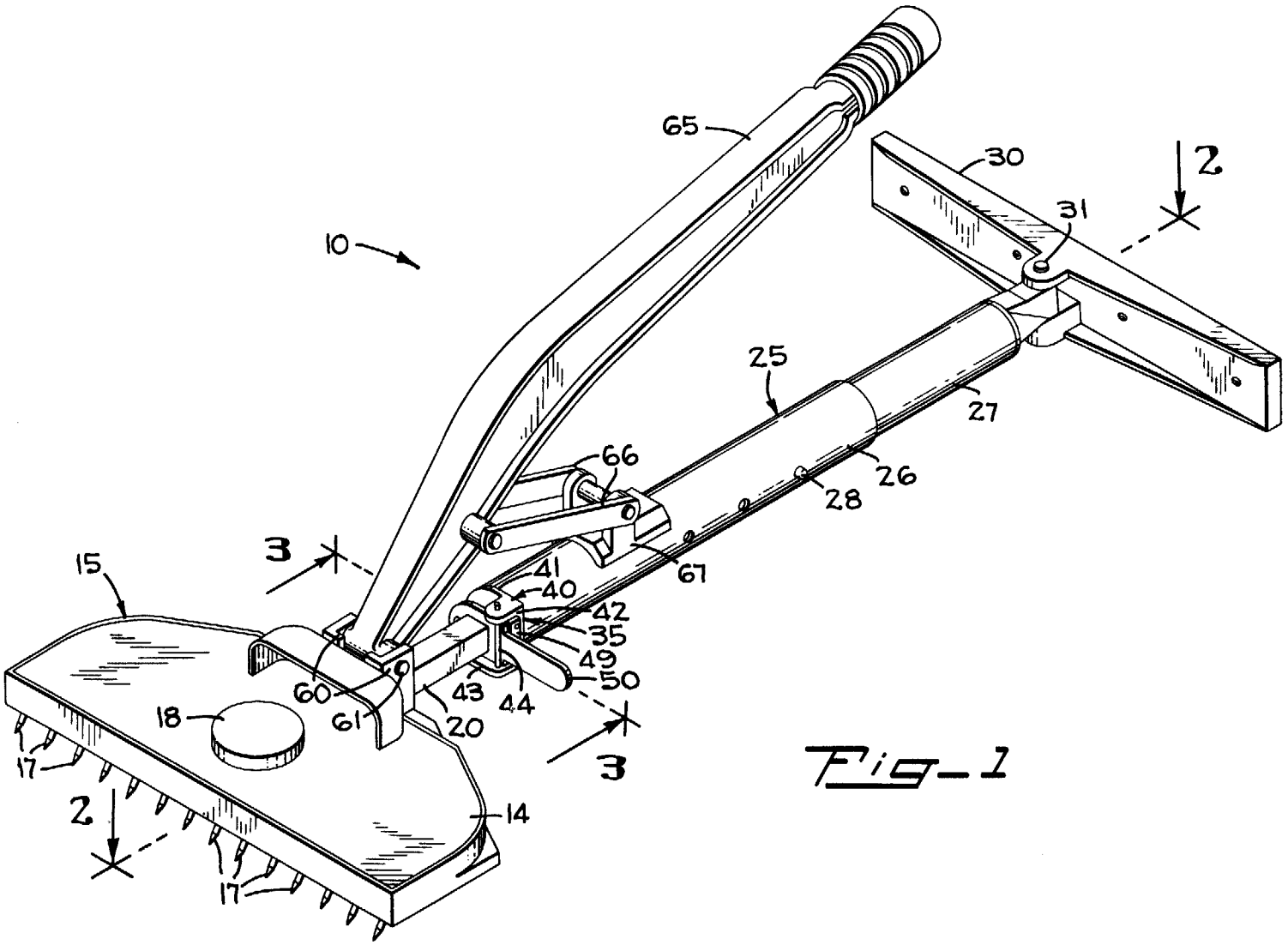
FIG. 1 is a perspective view of a carpet stretcher embodying the present invention.
Figure 2:
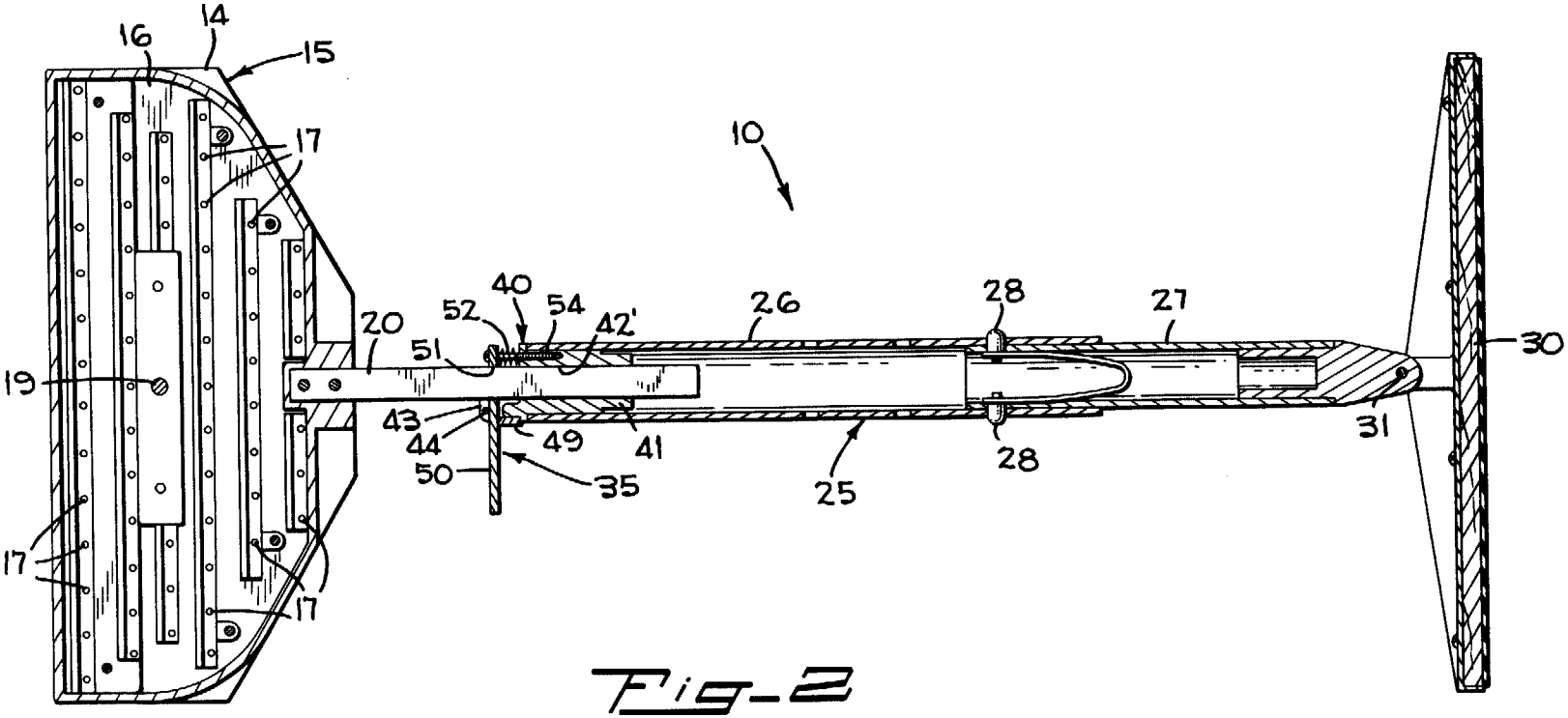
FIG. 2 is a horizontal sectional view of the carpet stretcher shown in FIG. 1 taken along line 2—2 of FIG. 1.

Illustrated in FIG. 1 is a carpet stretcher 10 embodying the present invention. The carpet stretcher 10 comprises a pin head 15, which includes a suitable housing 14. Mounted in the housing 14 to be exposed to a carpet to be stretched is a horizontally disposed plate 16. Projecting from the plate 16 are carpet engaging pins 17, which penetrate the carpet to be engaged. The carpet engaging pins 17 are fixed to the plate 16 in a conventional and well-known manner. The height of the plate 16 is adjustable within the housing 14 in a well-known manner through a knob 18 that rotates a threaded post 19. The threaded post 19 is journalled for rotation by the housing 14. The plate 16 has an aperture surrounded by a threaded wall, which is in engagement with the threaded post 19 so that rotation of the post 19 varies the height of the plate 16 to vary the penetration of the carpet engaging teeth 17 with the carpet to be stretched.

Extending rearwardly from the rear wall of the housing 14 of the pin head 15 is a sliding bar 20, which has a rectangular cross-sectional area. In the exemplary embodiment, the bar 20 has a square cross-sectional area. The sliding bar 20 is freely received by a tubular extension assembly 25. The sliding bar 20 is disposed along the axis of the tubular extension assembly 25. In the preferred embodiment, the tubular extension assembly 25 comprises telescoping, extensible tubular members 26 and 27. The telescoping tubular members 26 and 27 are adjustable to control the insertion or retraction of the tubular member 27 within the tubular member 26. Toward this end, each of the tubular members have radial apertures formed therein. By registering apertures of the tubular members for diametric alignment, spring-loaded plungers 28 will be retracted through aligned apertures to retain the tubular members in an adjusted position. Depressing the spring-loaded plungers 28 and moving the tubular member 27 in the axial direction until another set of registering apertures are aligned will retain the tubular members in another adjusted position.

At the free or rearward end of the tubular extension member is pivotally mounted a well-known and conventional wall engaging member 30. The wall engaging member 30 has a vertical wall to engage the base wall of a room to be carpeted and is pivotal about a vertically disposed pin 31 mounted on the rearward end of the tubular extension assembly 25.

At the forward end of the tubular extension assembly 25 is mounted a locking mechanism 35 for temporarily retaining or holding the sliding bar 20 in a fixed position relative to the tubular extension assembly 25 so that the pin head 15 will be temporarily retained at a selected distance from the wall engaging member 30 before being released. For this purpose, a right angular bracket 40 is fixed to the forwardmost end of the tubular extension assembly 25. The right angular bracket 40 includes a block 41 that extends transversely relative to the bar 20. Formed in the block 41 is an aperture 42' through which the sliding bar 20 is freely received. Integrally formed with the block 41 of the bracket 40 is an upstanding side plate 42 that extends in the axial direction parallel to and alongside of the sliding bar 20. A bottom plate 43 extends transversely to the sliding bar 20 and is integrally formed with the side plate 42. The bottom plate 43 serves to guard against tufts from the carpet from getting into the operating parts of the locking mechanism 35.

A vertically disposed pin 44 extends between the plates 42 and 43. A holding or locking lever 50 is disposed transversely relative to the sliding bar 20. A face plate of the holding lever 50 is apertured at 51 to receive the sliding bar 20. The aperture 51 of the holding lever 50 is configured similarly to the cross-sectional area of the sliding bar 20, but is slightly larger than the cross-sectional area of the sliding bar 20. The holding lever 50 is retained for pivotal movement within the bracket 40 between a vertical plate 49 and the pin 44 and is pivotal about a vertical axis at a pivot point 48 (FIG. 4) in the general direction relative to the sliding bar 20 and the tubular members 25 and 26. The plate 49 is bolted to the block 41. When the holding lever 50 is at right angles to the sliding bar 20, the sliding bar 20 is freely movable within the aperture 51. When the holding lever 50 is pivoted away from the right angular position, the walls surrounding the aperture 51, in the exemplary embodiment, move rearwardly to grip the walls of the sliding bar 20 to lock or hold the sliding bar 20 in a fixed position relative to the tubular member 26 at points 46 and 47 (FIG. 4). A suitable spring 52 between the holding lever 50 and the transverse plate 41 of the bracket 40 urges the lever 50 in the position to disengage the sliding bar 20 and to permit the sliding bar 20 to be freely movable. The spring 52 is mounted on a bolt 54 that is secured to the block 41 and is received by the lever 50. The spring 52 is disposed between the block 41 and the lever 50.

At the rearward wall of the pin head housing 14 are upstanding ears 60. Pivotally attached to the pin head housing 14 through the upstanding ears 60 and a shaft 61 is a handle 65. Parallel links 66 are pivotally connected to the handle 65 and a bracket 67 that is fixed to the tubular member 26.

The wall engaging member 30 is placed against a suitable wall and the pin head 15 is placed in engagement with carpet to be stretched. The handle 65 is in an elevated position. The operator depresses the handle 65 until the carpet is stretched to a desired extent through the pin head 15. In stretching the carpet, an axial force in the direction shown by an arrow 70 (FIG. 4) is applied to the carpet via the pin head 15. After the carpet is stretched to the desired extent, the operator pivots the lever 50 about the vertical axis at point 48 of the plate 49 so that the lever 50 engages the sliding bar 20 at the points 46 and 47. From FIG. 4, the position of the lever 50 in engagement with the sliding bar 20 and out of engagement with the sliding bar 20 can be observed.

When a carpet is stretched, the carpet produces an axial reaction force in the direction shown by an arrow 71 (FIG. 4). By pivoting the lever 50 about the vertical axis at point 48 of the plate 49 to engage the lever 50 with the sliding bar 20 at the points 46 and 47, the lever 50 retains the sliding bar 20 in the extended carpet stretch position against the axial reactive force produced by the stretched carpet. In so doing, the pin head 15 is held in the carpet stretching position against the axial reactive force produced by the stretched carpet. The greater the axial reactive force, the greater the locking force between the lever 50 and the sliding bar 20.

Subsequently, the operator depresses the handle 65 to release the axially reactive force and to enable the return of the locking lever 50 to the position at right angles to the sliding bar 20. When so positioned, the lever 50 is not in locking engagement with the sliding bar 20. The spring 52 continuously urges the lever 50 to be positioned at right angles to the sliding bar 20.

I claim:

1. A carpet stretcher comprising:

(a) a pin head;

(b) a sliding bar fixed to said pin head and extending rearwardly therefrom;

(c) a tubular assembly freely receiving said sliding bar in the axial direction thereof;

(d) a wall engaging member mounted on the rearward end of said tubular assembly;

(e) a sliding bar locking mechanism fixed to the forward end of said tubular assembly, said sliding bar locking mechanism including a movable locking lever extending transversely relative to said sliding bar and formed with an aperture to receive said sliding bar, said locking lever being movable to retain said sliding bar in a fixed position relative to said tubular assembly and being movable to release said sliding bar for enabling said sliding bar to be freely movable relative to said tubular assembly;

(f) a handle pivotally connected to said pin head and projecting in the general direction of said tubular assembly; and (g) linkage interconnecting said handle and said tubular assembly, the movement of said handle enables said locking lever to be released from locking engagement with said sliding bar.

2. A carpet stretcher as claimed in claim 1 wherein said sliding bar locking mechanism comprises means for supporting said locking lever for pivotal movement about a vertically disposed axis, said locking lever being movable in a generally fore and aft direction relative to said sliding bar for engaging said sliding bar to lock said sliding bar in a fixed position relative to said tubular assembly and for releasing said sliding bar to enable said sliding bar to be moved relative to said tubular assembly, the movement of said handle enables said locking lever to move in a direction to release said sliding bar from locking engagement.

3. A carpet stretcher as claimed in claim 1 wherein said aperture formed in said sliding bar locking lever is shaped to conform to the configuration of the cross-sectional area of said sliding bar but greater in dimension.

4. A carpet stretcher as claimed in claim 3 wherein said sliding bar has a rectangular cross-sectional area.

5. A carpet stretcher as claimed in claim 2 wherein said aperture formed in said sliding bar locking lever is shaped to conform to the configuration of the cross-sectional area of said sliding bar but greater in dimension.

6. A carpet stretcher as claimed in claim 5 wherein said sliding bar has a rectangular cross-sectional area.

7. A carpet stretcher comprising:

(a) a pin head;

(b) a sliding bar fixed to said pin head and extending rearwardly therefrom;

(c) a tubular assembly freely receiving said sliding bar in the axial direction thereof;

(d) a wall engaging member mounted on the rearward end of said tubular assembly;

(e) a sliding bar locking mechanism fixed to the forward end of said tubular assembly, said sliding bar locking mechanism including a movable locking lever extending transversely relative to said sliding bar and formed with an aperture to receive said sliding bar, said locking lever being movable to retain said sliding bar in a fixed position relative to said tubular assembly and being movable to release said sliding bar for enabling said sliding bar to be freely movable relative to said tubular assembly;

(f) a handle pivotally connected to said pin head and projecting in the general direction of said tubular assembly; and (g) linkage interconnecting said handle and said tubular assembly, the movement of said handle enables said locking lever to be released from locking engagement with said sliding bar, (h) said sliding bar locking mechanism further comprising:

a right angular bracket fixed to the forward end of said tubular assembly, said right angular bracket being formed with a first plate extending transversely relative to said sliding bar, a second plate extending in the general direction of said sliding bar along a side of said sliding bar, and a third plate spaced from said second plate, said first plate being apertured to freely receive said sliding bar, and a vertically disposed pin mounted on said second plate, said locking lever being disposed between said third plate and said pin for pivotal movement about a vertically disposed axis, said locking lever being movable in a generally forward aft direction relative to said sliding bar for engaging said sliding bar to retain said sliding bar in a fixed position relative to said tubular assembly and for releasing said sliding bar to enable said sliding bar to be moved relative to said tubular assembly, the movement of said handle enables said locking lever to move in a direction to release said sliding bar from locking engagement.

8. A carpet stretcher as claimed in claim 7 wherein said aperture formed in said sliding bar locking lever is shaped to conform to the configuration of the cross-sectional area of said sliding bar but greater in dimension.

9. A carpet stretcher as claimed in claim 8 wherein said aperture formed in said first plate is shaped to conform to the configuration of the cross-sectional area of said sliding bar but greater in dimension.

10. A carpet stretcher as claimed in claim 9 wherein said sliding bar has a rectangular cross-sectional area.

11. A carpet stretcher as claimed in claim 7 wherein said right angular bracket includes a bottom plate disposed below said lever to inhibit tufts of carpet from entering said sliding bar locking mechanism.

* * * * *